United States Patent [19]

Schroeder

[11] 4,403,364

[45] Sep. 13, 1983

[54] AUTOMATIC BRUSH CLEANER

[75] Inventor: Robert W. Schroeder, Bensenville, Ill.

[73] Assignee: RoMark Technology, Inc., Itasca, Ill.

[21] Appl. No.: 341,272

[22] Filed: Jan. 21, 1982

[51] Int. Cl.[3] ..... A46B 13/04

[52] U.S. Cl. ..... 15/4; 15/38

[58] Field of Search ..... 15/21 B, 21 C, 21 D, 15/38, 39, 70, 97 R, 4; 134/6

[56] References Cited

U.S. PATENT DOCUMENTS

| | | | |
|---|---|---|---|
| 185,737 | 12/1876 | Ferguson . | |
| 1,988,997 | 1/1935 | Charron et al. . | |
| 2,640,489 | 6/1953 | Boland . | |
| 2,665,697 | 1/1954 | Hohl et al. . | |
| 3,058,134 | 10/1962 | Wozniak-Rennek . | |
| 3,129,451 | 4/1964 | Colaianni . | |
| 3,217,349 | 11/1965 | Hull et al. | 15/38 X |
| 3,982,296 | 9/1976 | Russo . | |

FOREIGN PATENT DOCUMENTS

| | | | |
|---|---|---|---|
| 578309 | 6/1933 | Fed. Rep. of Germany . | |
| 2304632 | 11/1977 | Fed. Rep. of Germany | 15/38 |

*Primary Examiner*—Edward L. Roberts

*Attorney, Agent, or Firm*—Leydig, Voit, Osann, Mayer & Holt, Ltd.

[57] ABSTRACT

An apparatus for automatically cleaning and sanitizing brushes such as hair brushes including a carrier which supports and carries a brush to be cleaned along a predetermined path and disposed alongside this path are a plurality of cleaning and sanitizing devices. The latter include one or more rotary cleaning members with fingers which engage and clean the bristles of the devices and nozzles disposed both before and after the rotary members. Liquid soap or plain hot water is selectively sprayed through the nozzles and onto the bristles with at least the last effective nozzle spraying a rinse of hot water. A cam co-acts with a follower on the carrier to turn the brush so that the bristles face the cleaning devices and thereafter the cam is effective to oscillate the brush as the latter passes the cleaning devices so that all the bristles are presented to each of these devices. As the brush nears the end of its path of travel, the cam and follower oscillate the brush vigorously to shake excess water from the bristles. As disclosed, the apparatus also includes a chamber for drying and sanitizing cleaned brushes and another chamber for storing the brushes after they have been dried.

18 Claims, 14 Drawing Figures

AUTOMATIC BRUSH CLEANER

BACKGROUND OF THE INVENTION

The present invention relates to apparatus for cleaning brushes such as hair brushes and particularly to such an apparatus as might be used by professional hair stylists, beauticians and barbers.

SUMMARY OF THE INVENTION

The general object of the invention is to provide a novel automatic apparatus for rapidly and effectively removing foreign matter such as, for example, loose hair and dirt from the bristles of a brush and for sanitizing the brush for reuse.

A more detailed object is to carry the brush along a predetermined path past one or more cleaning devices and both to present the bristles of the brush to each cleaning device and to oscillate the brush relative to the cleaning device as it passes the device so that all of the bristles are cleaned.

A further object is to form at least one of the cleaning devices as a rotary member with radially projecting fingers which engage and clean the bristles of the brush.

A still more detailed object is to utilize at least two rotary cleeaning members disposed side by side and to employ one or more spray nozzles in advance of the rotary members and one or more spray nozzles after the rotary members together with means for selectively delivering either liquid soap or hot water under pressure to be sprayed through the nozzles and onto the bristles of the brush.

Another object is to arrange the parts so that the last effective nozzle sprays hot water to rinse the brush bristles and thereafter to osciallate the brush vigorously to shake excess water from the bristles.

The invention also resides in the details of the means for carrying the brush and the various cleaning devices and in the novel cam mechanism for imparting the turning and osciallating motions to the brush.

DETAILED DESCRIPTION OF THE PREFERRED EMBODIMENT

Figure 1:
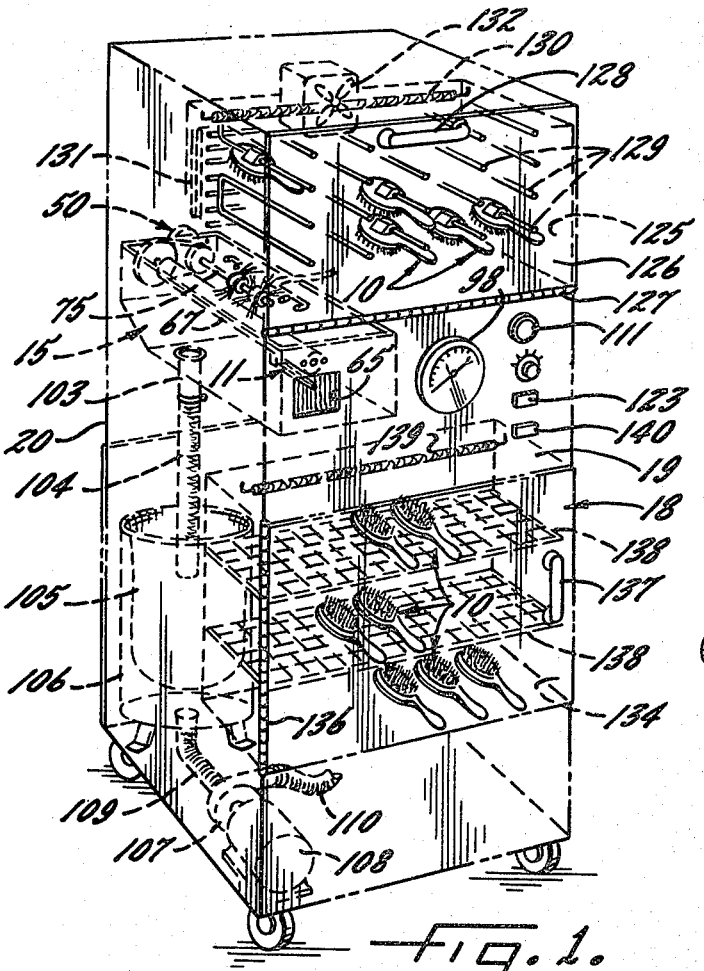
FIG. 1 is a perspective view of an automatic brush cleaner incorporating the cleaning apparatus of the present invention.

The present invention contemplates the provision of a novel apparatus for cleaning and sanitizing brushes, particularly hair brushes 10 and, in general, includes a carrier 11 which releasably supports a brush to be cleaned and presents the bristles 12 of the brush in a unique and effective manner to one or more cleaning devices. More specifically, the carrier moves along a predetermined path through a plurality of stations each having a cleaning device. A cam 13 extends along the path and co-acts with a follower 14 (FIG. 7) on the carrier to turn the latter arcuately about the line of travel and the cam is shaped to present the bristles of the brush 10 to the cleaning device at each of the stations. In addition, the cam also arcuately oscillates the carrier and hence the bruch at least at one of the stations, and preferably at all of the stations, to effectively clean all the bristles of the brush.

In the form shown in the drawings, the carrier 11 and the cleaning devices are disposed within an elongated rectangular sheet metal box 15 which includes opposed front and rear end walls 16 and 17 and which is horizontally mounted in an upright cabinet 18 with the front and rear walls of the box being generally flush respectively with the front and rear walls 19 and 20 of the cabinet. The path of the carrier 11 is straight and extends from a position adjacent the front wall 16 to a position near the rear wall 17 and back. The cleaning devices include at least one nozzle which sprays a liquid on the bristles 12 of the brush 10, at least one power-rotated member with generally radially projecting fingers which engage the bristles, and another nozzle which subsequently sprays the bristles again. Herein, there are six aligned stations 21, 22, 23, 24, 25 and 26 (FIGS. 4 and 5) with nozzles 27 and 28 located at the first two stations 21 and 22, rotating members 29 and 30 at the next two stations 23 and 24 and nozzles 31 and 32 at the last two stations 25 and 26.

Drive mechanism is provided to move the carrier 11 back and forth between the front and rear end walls 16 and 17 of the box 15. Herein, this mechanism includes a horizontal screw 33 extending between the end walls and a nut 34 which is threaded on the screw and which is part of the carrier. As will be explained more in detail, the cam 13 and the follower 14 generally hold the nut from turning and, accordingly, the nut travels along the screw as the latter is rotated. The screw is formed with a forward thread 35 which drives the nut from the front end wall 16 to the rear end wall 17 and a return thread 36 which drives the nut in the reverse direction.

Figures 8, 9:
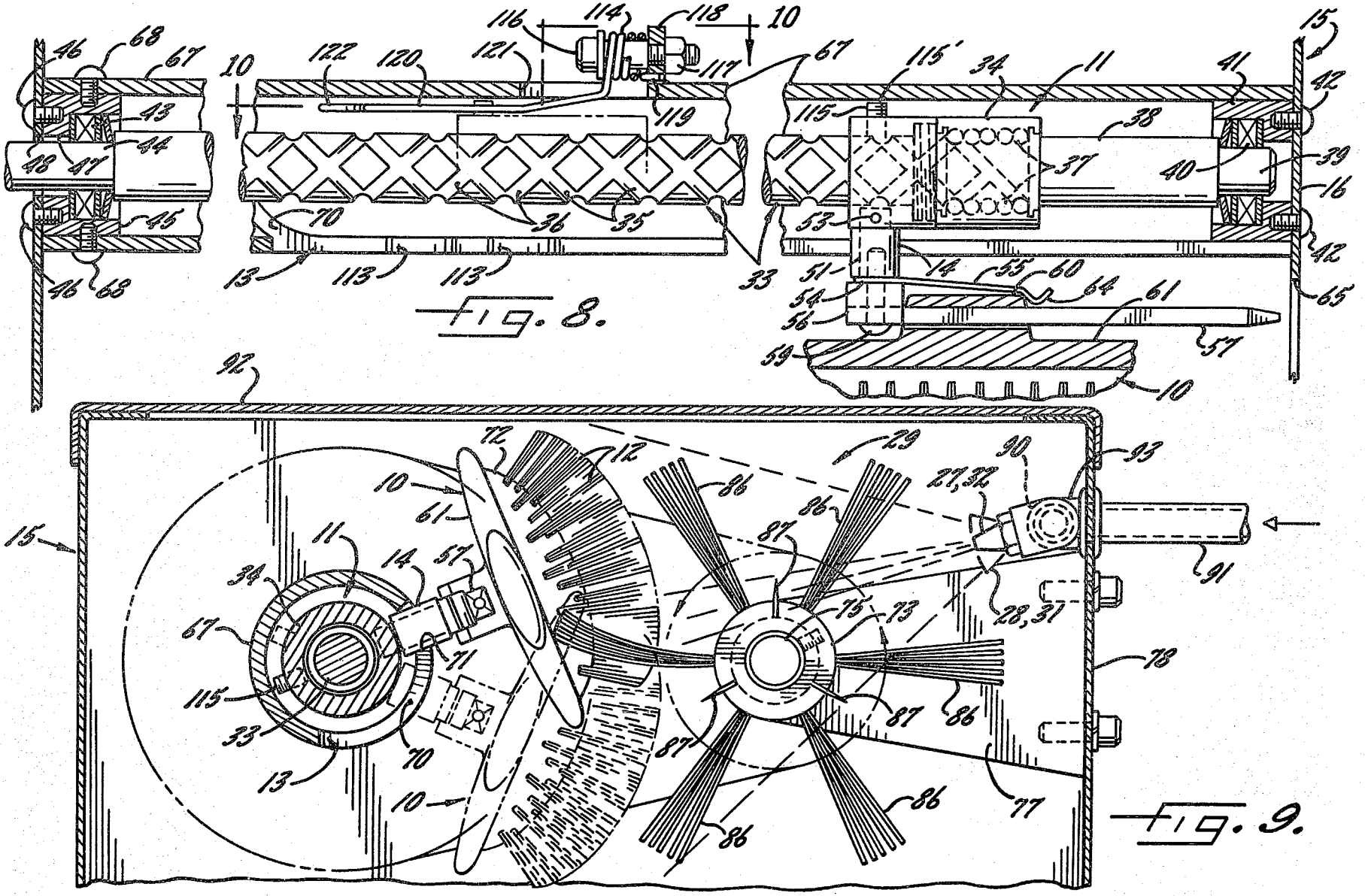
FIG. 8 is an enlarged sectional view taken along the line 8—8 in FIG. 5.
FIG. 9 is an enlarged fragmentary sectional view taken along the line 9—9 in FIG. 5.
Figure 10:
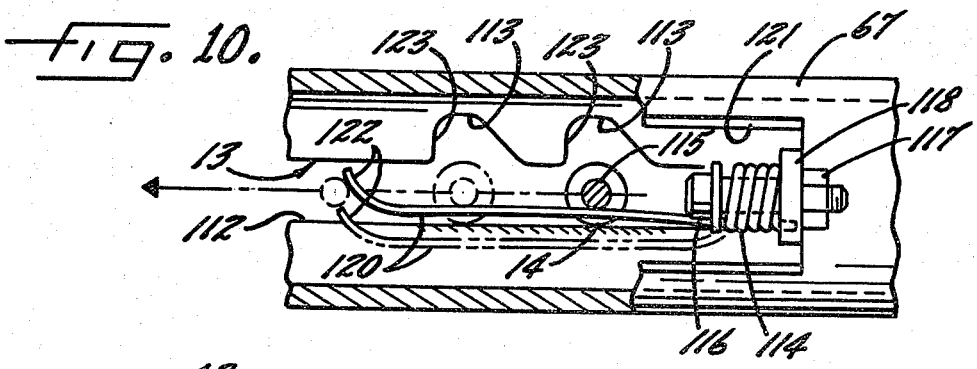
FIG. 10 is a fragmentary sectional view taken along the line 10—10 in FIG. 8.
Figure 11:
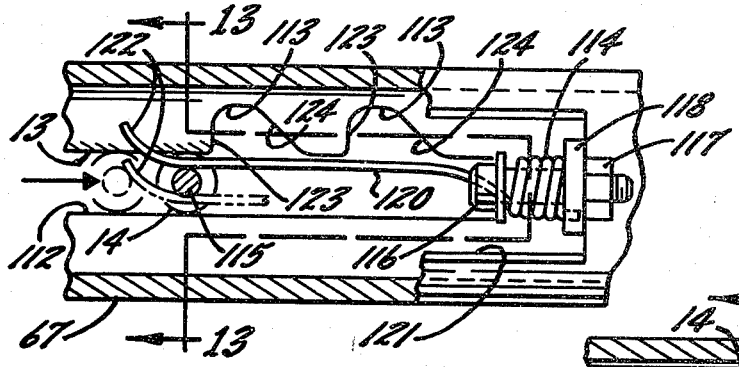
FIG. 11 is a sectional view similar to FIG. 10 but showing the parts in a moved position.
Figure 12:
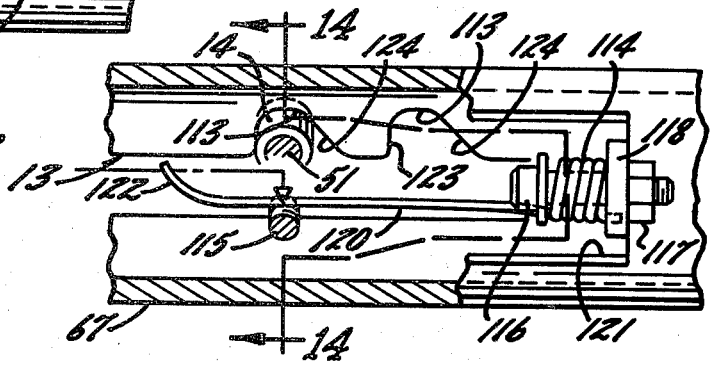
FIG. 12 is a fragmentary sectional view similar to FIG. 10 showing the parts in a still further moved position.

As shown in FIG. 8, the screw 33 and the nut 34 are a conventional ball screw and nut assembly with balls 37 (FIG. 8) which are captured within the nut and roll along either the thread 35 or the thread 36 which are in the form of grooves. The screw is fast on a shaft 38 with the forward end portion 39 of the shaft reduced and journaled in a bearing 40. The latter is mounted in a cylindrical plug 41 which is fastened to the front end wall 16 by the screws 42. At its rear end, the shaft 38 is reduced in cross section as indicated at 44 and is journaled in another bearing 43 mounted in a second cylindrical plug 45 which is fastened to the rear end wall 17 by screws 46. The end portion 44 projects through holes 47 and 48 in the plug 45 and the rear end wall where the shaft is driven by a motor 49 (FIG. 4) through a drive train 50.

To complete the carrier 11, a stub shaft 51 (FIGS. 7 and 8) received in a radial bore 52 in the periphery of the nut 34 projects radially outwardly from the nut and is pinned to the latter as indicated at 53. An end portion 54 of an elongated spring finger 55 abuts the underside of the stub shaft with the finger projecting horizontally toward the front end wall 16 of the box 15. A washer 56 abuts the underside of the finger end portion 54 and the end portion of a flat bar 57 is received in a recess 58 in the washer with the bar being disposed beneath and generally paralleling the spring finger. This assembly is held together by a screw 59 which projects through the bar, the washer and the spring end portion 54 and is threaded into the end of the stub shaft 51.

Figure 2:
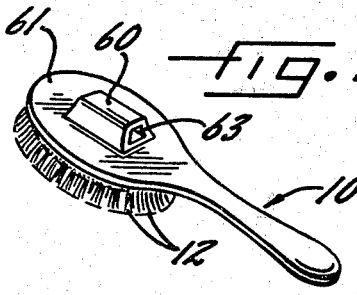
FIG. 2 is a perspective view of a brush especially made for use with the apparatus.
Figure 3:
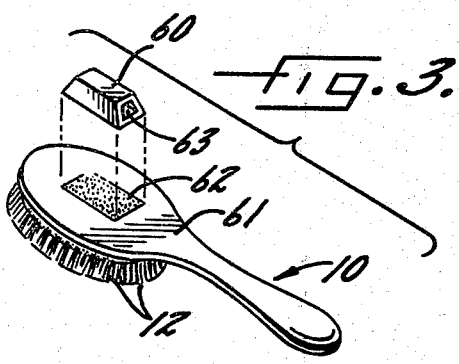
FIG. 3 is an exploded perspective view of a regular brush adapted for use with the apparatus.

The spring finger 55 and the bar 57 are utilized to releasably hold the hair brush 10 on the carrier 11 and, to this end, a block 60 is rigid with the back 61 of the brush. The block may either be an integral part of the back as shown in FIG. 2 or it may be a separate part secured to the back by an adhesive 62 as illustrated in FIG. 3. The block 61 is formed with a longitudinal hole 63 which is of a size and shape generally complemental to the cross section of the bar 57 so that the block may be received on the bar which thereby supports the brush on the nut 34. As the block is slid onto the bar, the upper side of the block engages a downwardly projecting hook 64 on the free end of the spring finger 55 and resiliently cams the finger upwardly. When the forward end of the block abuts the washer 56, the hook snaps down behind the block as shown in FIG. 8 to releasably hold the brush on the carrier. To permit the brush to be placed on and removed from the carrier when the latter is adjacent the front end wall 16, this wall is formed with a rectangular opening 65 (FIGS. 1 and 5) through which the brush may be moved into and out of the box 15. Flexible strips 66 may be attached to the wall 16 to hand down over the opening and prevent liquid from the cleaning nozzles from spraying out of the box while permitting the brush to pass through the opening, the box also having a removable cover 92.

Figure 7:
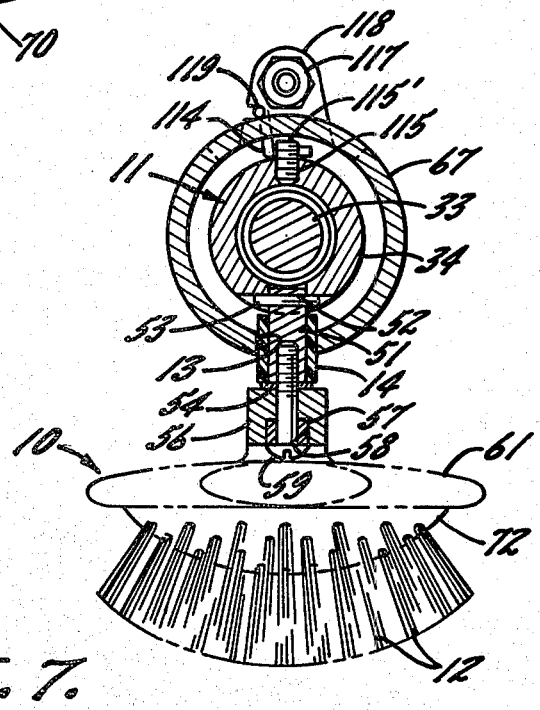
FIG.7 is an enlarged sectional view taken along the line 7—7 in FIG. 5.

In the present instance, the cam 13 is a slot formed longitudinally in a sleeve 67 which encircles the screw 33 and the nuts 34. The sleeve spans the end walls 16 and 17 of the box 15 and its ends are telescoped over the plugs 41 and 45 which support the sleeve. Screws 68 project through the end portions of the sleeve and are threaded into the plugs 41, 45 to prevent the sleeve from turning. As shown in FIGS. 7 and 8, the stub shaft 51 projects through the cam slot 13 and the cam follower 14 is a plastic sleeve which encircles the stub shaft and engages the sides of the slot. Thus, except for the limited turning of the nut 34 as permitted by the shape of the cam slot, the follower and the slot hold the nut against turning so that the nut travels along the screw 33 as the latter is rotated.

Figure 6:
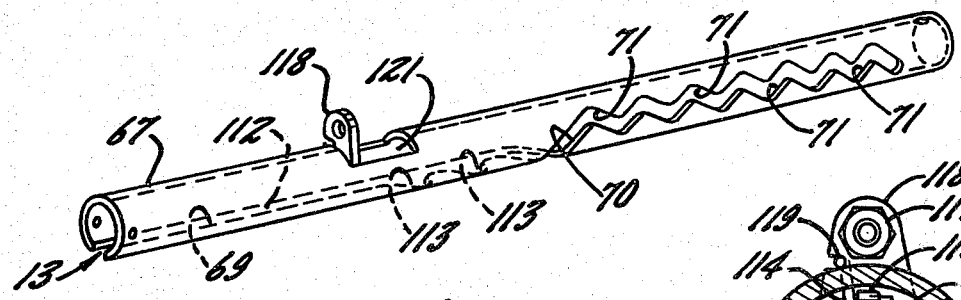
FIG. 6 is a perspective view of the cam used to control the motion of the brush during cleaning.

In the form of the invention illustrated in the drawings, the brush 10 initially is supported on the carrier 11 with the bristles 12 pointed down. The nozzles 27, 28, 31 and 32 and the cleaning members 29 and 30, however, are aligned horizontally along one side of the screw 33. Accordingly, the initial portion 69 of the cam slot is straight and opens downwardly. At the point where the brush approaches the first station 21, the follower 14 engages a ramp 70 (FIG. 6) in the cam slot and this turns the carrier. Because of the non-circular cross sections of the bar 57 and the hole 63, the brush turns through approximately 90 degrees so that the bristles face sidewise toward the nozzles and the cleaning members. Thereafter, the cam slot is formed with zigzag portions 71 which extend above and below the centerline of the screw 33 so that the carrier and the brush are oscillated up and down between an upper position as shown in solid lines in FIG. 9 and a lower position as illustrated in broken lines. These portions 71 of the slot are arranged so that there is at least one complete oscillation of the brush as it passes through each cleaning station. Thus, all of the bristles are presented to each nozzle and to each cleaning member even though the bristles may be supported by an arcuate underside 72 of the brush.

Figure 4:
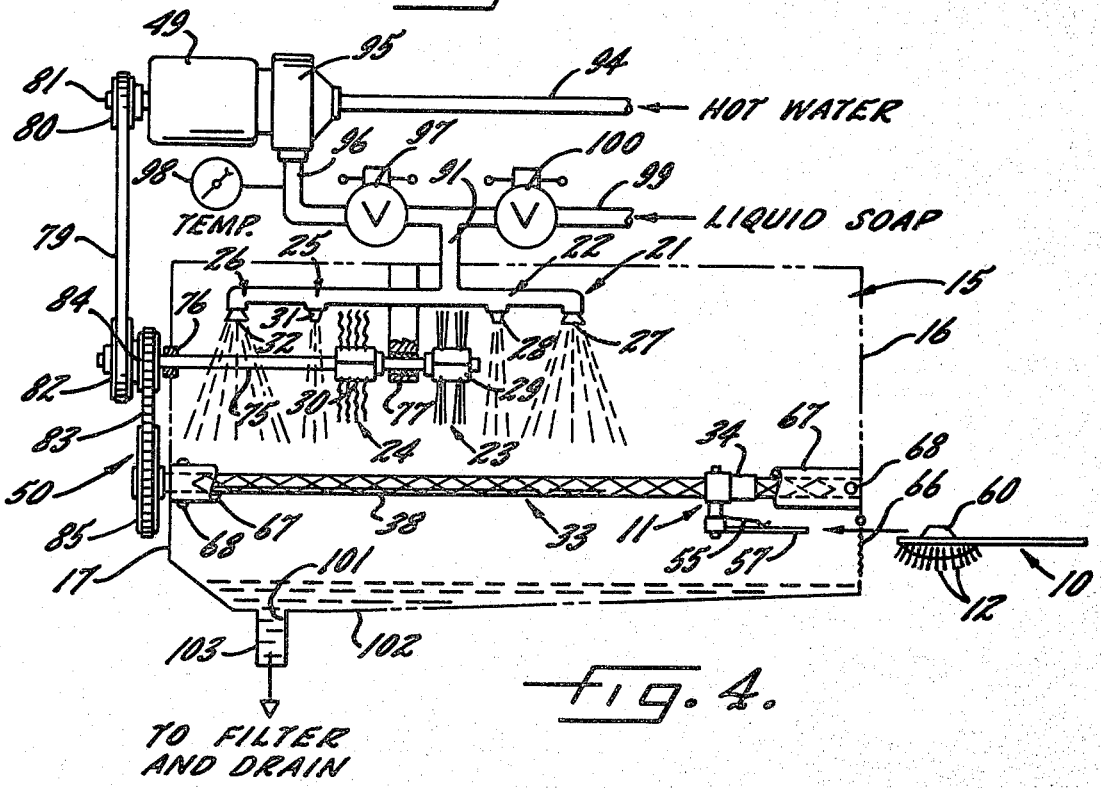
FIG. 4 is a schematic view of the brush cleaning apparatus.
Figure 5:
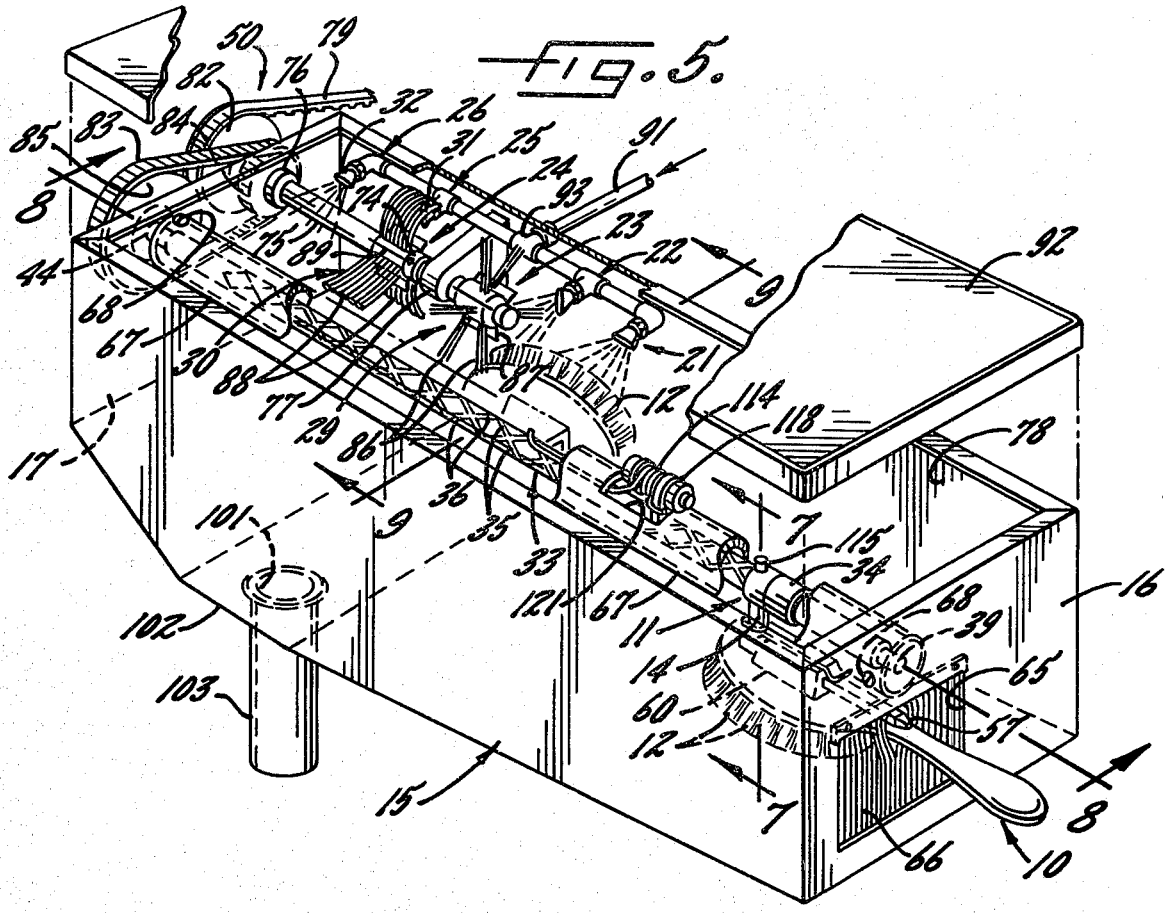
FIG. 5 is an enlarged fragmentary perspective view of the brush cleaning apparatus.

As shown in FIGS. 4 and 5, the rotating cleaning members 29 and 30 include hubs 73 and 74 respectively which are keyed to a horizontal shaft 75. This shaft parallels the screw 33 in the same general horizontal plane as the screw and is journaled in the box 15 by means of a bearing 76 in the rear end wall 17 and a bracket 77 secured to a side wall 78 of the box. The shaft 75 projects through the rear end wall so that it, like the screw, may be driven by the motor 49 through the drive train 50. Thus, the drive includes a gear belt 79 trained about a toothed pulley 80 on the motor shaft 81 and a second toothed pulley 82 fast on the outer end of the shaft 75 so that the motor drives the shaft through the pulleys and the belt. The shaft 75 and the screw 33 are driven in synchronization but with the screw turning at a slower speed by an endless chain 83 which extends around a sprocket 84 on the shaft 75 and a larger sprocket 85 on the screw shaft 38.

The fingers of the rotary cleaning member 29 herein are comparatively stiff wire bristles 86 projecting radially from the hub 73 and arranged in six groups equally spaced around the hub. As illustrated in FIG. 9, the bristles 86 are sufficiently long to project through the entire length of the bristles 12 of the brush 10 and to flex against the brush bottom 72. Thus, the wire bristles remove hair entrained in the brush bristles or at least bring the hair to the outer ends of the brush bristles. In order that the matting of the hair as it is removed does not impede the effectiveness of the wire bristles, the cleaning member 29 also includes a plurality of knife blades 87 which are mounted on the hub 73 and cut the matted hair. Herein, there are three such blades equally spaced around the hub and anchored in the latter with the blades projecting radially from the hub and extending longitudinally of the shaft 75.

In the present instance, the fingers of the second rotary cleaning member 30 are intended primarily to remove hair left on the ends of the bristles 12 of the brush 10 by the cleaning member 29 and, to this end, the fingers on the member 30 are flat strips 88 of a flexible material such as rubber or the like. The strips are arranged in three groups equally spaced angularly around the hub 74 of the member 30 with the inner ends of the strips anchored in the hub. The strips are long enough that their free end portions flap against the ends of the brush bristles 12 to remove loosened hair therefrom. If desired, the member 30 may include knife blades 89 similar to the blades 87 to cut up matted hair being removed by the strips.

The four nozzles 27, 28, 31 and 32 are mounted on and communicate with the interior of a horizontal manifold pipe 90 (FIGS. 4 and 5) which is disposed behind and slightly above the shaft 75 and parallels the latter. An inlet pipe 91 projecting through and mounted on the side wall 78 of the box 15 is connected by a T-joint 93 to the manifold pipe to support the latter and to supply liquid to the nozzles through the manifold pipe. Hot water is drawn from a suitable source (not shown) through a pipe 94 by a pump 95, which is driven by the motor 49, and the water is delivered to the inlet pipe 91 from the pump through a pipe 96 which is controlled by a solenoid-operated valve 97, the temperature of the water being visually shown by an indicator 98 which communicates with the pipe 96 and is mounted on the front wall 19 of the cabinet 18 (see FIG. 1). In order to sanitize the brushes, the temperature of the water should be at least 180° Fahrenheit, and preferrably suitable controls are provided to prevent cycling of the machine when the water temperature is below such temperature. Liquid soap from a suitable source (now shown) also is delivered to the inlet pipe 91 and hence to the nozzles through a pipe 99 which is connected to the inlet pipe and is controlled by a second solenoid-operated valve 100. In the present instance, the soap is concentrated and includes a disinfectant and the soap is mixed with water from the pipe 96 with the water drawing the soap into the pipe 91 by a jet pumping action, the ratio of water to soap concentrate being on the order of twenty to one. In other words, water is delivered to the nozzles when the valve 97 is open and the valve 100 is closed and soap is delivered to the nozzles when both valves are open. Thus, by selectively controlling the valves 97 and 100, soap or hot rinse water may be sprayed through the nozzles.

As shown in FIGS. 4 and 5, the nozzles 27 and 32 are shaped to spray liquid in a generally horizontal plane and the nozzles 28 and 31 are shaped to spray in a generally vertical plane so that a brush 10 being cleaned is sprayed vertically and horizontally both before and after it is engaged by the rotary cleaning members 29 and 30. After being sprayed on the brush, the liquid from the nozzles, together with hair removed from the brush 10, drains through a hole 101 in the bottom wall 102 (FIG. 5) of the box 15 and a rigid tube 103 secured to the bottom wall. A flexible tube 104 (FIG. 1) is attached to the tube 103 and leads to the filter bag 105 removable supported in a drum 106 so that the hair is collected in the bag while the liquid filters through the bag to the bottom of the drum, the drum being mounted in the cabinet 18 beneath the box 15. A pump 107 mounted in the bottom of the cabinet and driven by a motor 108 draws the filtered liquid out of the drum through a hose 109 and delivers the liquid to a drain through a hole 110.

The drive motor 49 and the solenoids of the valves 97 and 100 are operated by means of any suitable control circuit through a cycle in which the brush 10 moves from the position adjacent the front end wall 16 of the box 15 as shown in FIG. 5 to the rear end wall 17 and back to the starting position, each cycle being initiated by manually pressing a button 111 (FIG. 1) or the front wall 19 of the cabinet. In a typical cycle, the brush 10 is turned through 90 degrees during the beginning of its forward travel and then is sprayed with a solution of liquid soap and water at a temperature of 180° F. by the nozzles 27 and 28, the valves 97 and 100 being open. Next, the bristles 12 of the brush are engaged successively by the bristles 86 of the rotary member 29 and by the strips 88 of the rotary member 30 and then the brush bristles are sprayed again with soap solution by the nozzles 31 and 32. It will be appreciated that any long or matted hair which is removed from a passing brush by the bristles 86 and strips 88 and which tends to wrap around the rotating members upon which the bristles and blades are mounted will be severed by the respective blades 87 and 89. As the brush begins its return travel, the valve 100 is closed and the valve 97 remains open so that the nozzles 31 and 32 rinse the bristles 12 with hot water. The brush bristles next are engaged again by the rotary members 29 and 30 and then are given a final rinse of hot water by the nozzles 27 and 28.

Figure 13:
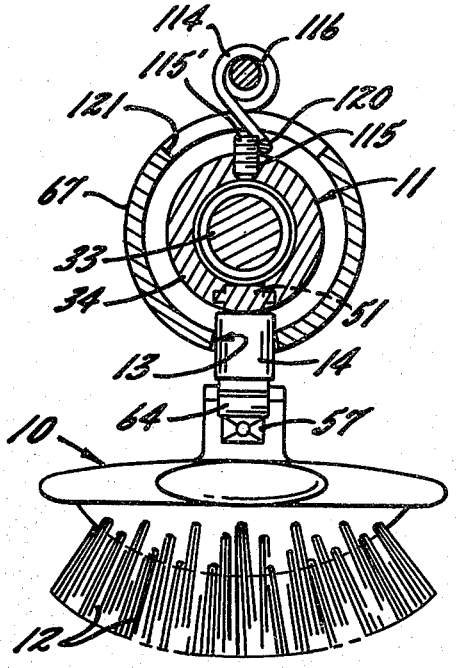
FIG. 13 is a sectional view taken along the line 13—13 in FIG. 11.
Figure 14:
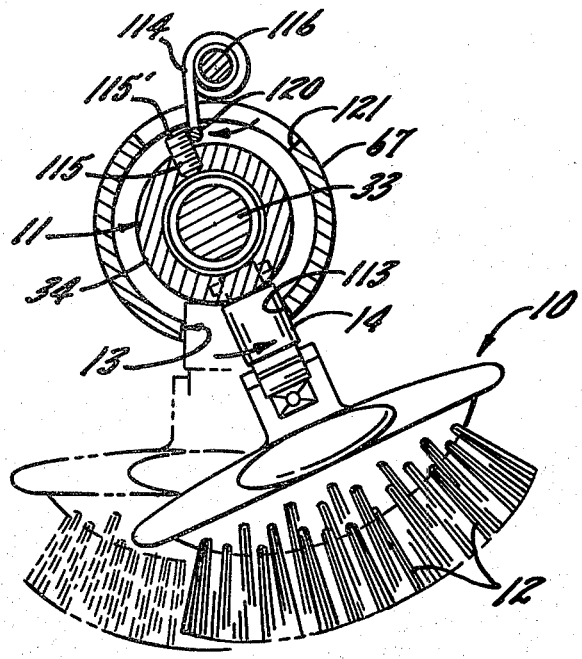
FIG. 14 is a sectional view taken along the line 14—14 in FIG. 12.

In the final portion of the return travel of the brush 10, the latter is oscillated rather vigorously to shake excess water from the bristles 12 and, preferably, this is done with the bristles facing downwardly. The cam slot 13 and follower 14 are used to effect this action and, for this purpose, the portion of the slot between the initial straight portion 69 and the ramp 70 has one side 112 straight (FIGS. 6, 10, 11 and 12) and the other side is formed with a plurality of notches 113, herein two in number. Means is provided to hold the follower against the straight side 112 on the forward travel of the brush and to cause the follower to enter the notches 113 on the return travel whereby the notches produce the shaking action. Herein, this means comprises a torsion spring 114 which is mounted on the sleeve 67 and engages the projecting end portion 115' of a screw 115 (FIGS. 7, 13 and 14) threaded into the nut 34 diametrically opposite the stub shaft 51.

More specifically, the torsion spring 114 is wound around a pin 116 (FIG. 8) which parallels the screw 33 and is clamped by a nut 117 to an ear 118 struck up form the upper side of the cam sleeve 67, the pin projecting from the ear in the direction of the forward movement of the nut 34. One end 119 of the spring is anchored in the ear and the other or free end portion 120 of the spring extends down through an opening 121 in the sleeve and projects along the screw toward the rear end wall 17 of the box 15. During the forward travel of the nut, the free end portion 120 of the spring is in its relaxed position as shown in full lines in FIG. 10 and the screw 115 passes to the right of this end portion as viewed in FIG. 7 as the follower 14 passes the notches 113 so that the spring resiliently prevents the nut from turning in a direction which would cause the follower to enter the notches. Once the follower has passed the notches, the screw 115 engages the curved end 122 of the spring and moves the spring to one side as shown in broken lines in FIG. 10 so that the pin passes the spring end portion 120 with the nut 34 traveling in a straight line.

As soon as the screw 115 passes the curved spring end 122, the free end portion 120 of the spring 114 returns to its relaxed position. As a result, on the return travel of the nut 34 the screw 115 engages the curved end and causes the spring to flex so that the screw passes along the other or left side of the end portion 120 as viewed in FIG. 13 (see also FIG. 11). This urges the nut to turn in the direction in which the follower 14 bears against the notched edge of the cam slot 13. As a result, the follower is successively moved into each of the notches 113 and, as the follower enters and leaves each notch, the brush 10 is swung to the side as shown by full lines in FIG. 14 (see also FIG. 12) and then returned to its downwardly facing polition illustrated in broken lines.

The entering edge 123 of each notch is generally circumferential of the sleeve 67 with the result that the follower enters each notch abruptly resulting in a vigorous shaking of the brush. To avoid the possibility of jamming, the leading edges 124 of the notches are inclined so that the follower is gradually cammed out of each notch.

The cabinet 18 includes a chamber 124 (FIG. 1) above the box 15 for drying cleaned brushes 10 and access to this chamber is obtained by opening a door 126 on the front of the cabinet, the door being horizontally hinged along its lower edge to the cabinet as indicated at 127 and being provided with a suitable handle 128. A plurality of horizontal rods 129 project forwardly from the rear of the cabinet and receive the holes 63 in the blocks 60 on the backs of the brushes to support the latter. An ultraviolet lamp 130 for further sanitizing the brushes extends across the top of the chamber and the air within the chamber is heated by electric heating elements 131 in the back of the chamber and circulated by an electric fan 132, the lamp, the heating elements and the fan being controlled through a suitable circuit (not shown) by a push button 133 on the front of the cabinet. The cabinet also provided with a storage chamber 134 below the box 15 and access to this chamber is achieved by opening a second door 135 which is supported on the cabinet along one side edge by a vertical hinge 136 and is provided with a handle 137. The brushes 10 are supported on racks 138 in the chamber 134 with the bristles 12 facing up and the bristles are subjected to the rays of a second sanitizing ultraviolet lamp 139 extending across the top of this chamber, this lamp being turned on and off by a switch button 140 on the front of the cabinet. The brushes stored in such compartment are maintained in a sanitized condition until reuse.

With the apparatus described above, a brush 10 is inseted through the opening 65 and slipped onto the rod 64 of the carrier 11 where it is held by the spring finger 55. A cleaning cycle is initiated by pressing the button 111 which energizes the various components of the apparatus. This turns the screw 33 to cause the nut 34 and hence the brush 10 to travel toward the rear end wall 17 of the box 15 and back to the starting position. At the same time, the shaft 75 is driven to turn the rotary cleaning members 29 and 30 and the valves 97 and 100 are sequentially operated to selectively spray either a soap and hot water solution or hot water through the nozzles 27, 28, 31 and 32. As the brush approaches the nozzle 27, the cam 13 turns the carrier so that the bristles 12 of the brush face the nozzles and the cleaning members and, thereafter, the cam oscillates the brush as it passes the nozzles and the cleaning members on both the forward and return travel of the carrier so that the brush bristles are thoroughly cleaned of loose hair and other foreign matter. Near the final portion of the return travel of the nut 34, the follower 14 enters the notches 113 in the cam slot 13 to vigorously oscillate the brush and shake excess water from the bristles. The cycle is complete when the carrier comes to rest at its original position at which time the cleaned brush is removed form the box 15 through the opening 65. It has been found that an effective cleaning cycle requires less than 15 seconds and, obviously, very little time is used in loading and unloading the brushes. Cleaned and sanitized brushes are hung on the rods 129 in the chamber 125 to dry and, thereafter, they are removed from the chamber 125 and stored on the racks 138 in the chamber 134.

I claim:

1. In an apparatus for cleaning brushes, the combination of, a carrier member adaped to releasably support and carry a brush to be cleaned, drive mechanism operable to move said carrier member and the supported brush along a predetermined path, said carrier member being turnable about the line of said path as the carrier member moves along the path, a cleaning member disposed along said path for engagement with the bristles of a brush supported by said carrier member and rotatable about an axis generally paralleling said line, power means for rotating said cleaning member, and means disposed along said path and engageable with one of said members, said means being operable to position said one member whereby the bristles of the brush face said cleaning member as the carrier member approaches the latter and to oscillate said one member and hence to oscillate the brush relative to the cleaning member as the bristles of the brush are engaged by the cleaning member.

2. Apparatus as defined in claim 1 in which said means engages, positions and oscillates said carrier member.

3. In an apparatus for cleaning brushes, the combination of, a carrier adapted to releasably support and carry a brush to be cleaned, drive mechanism operable to move said carrier and the supported brush along a predetermined path, said carrier being turnable about the line of said path as the carrier moves along the path, a cleaning member disposed along said path for engagement with the bristles of a brush supported by said carrier and rotatable about an axis generally paralleling said line, power means for rotating said cleaning member, and cam means disposed along said path and engageable with said carrier, said cam means being operable to position said carrier about said line with the bristles of the brush facing said cleaning member as the carrier approaches the latter and to oscillate the carrier and hence the brush as the bristles of the brush are engaged by the cleaning member.

4. Apparatus as defined in claim 3 in which said cleaning member includes a hub rotated by said power means and a plurality of sets of fingers anchored on said hub and projecting generally radially therefrom, said sets being equally spaced angularly around said hub and said fingers engaging the bristles of the brush to remove foreign material from the bristles.

5. Apparatus as defined in claim 4 including a plurality of knife blades anchored on said hub and extending longitudinally thereof with one blade being disposed between each adjacent set of fingers, said blades projecting radially from said hub and having their outer ends sharpened to cut material being removed from the bristles of the brush.

6. Apparatus as defined in claim 3 including a first nozzle disposed along said path in advance of said cleaning member, a second nozzle disposed along said path beyond said cleaning member, and means for delivering a liquid under pressure to said nozzles thereby to spray the liquid on the bristles of the brush, said cam means being operable to oscillate said carrier as the latter passes each of said nozzles.

7. Apparatus as defined in claim 6 in which said cam means is operable as said carrier approaches the end of said path to oscillate the carrier vigorously thereby to shake excess liquid from the bristles of the brush.

8. Apparatus for cleaning a brush comprising, an enclosure having an opening, a carrier adapted to releasably support and carry a brush to be cleaned, drive mechanism operable to move said carrier along a predetermined path within said enclosure, said path beginning and ending adjacent said opening whereby a hair brush may be placed on and removed from said carrier through said opening, means supporting said carrier to turn arcuately about said path as the carrier moves along the path, a plurality of stations disposed alongside said path, a cam disposed alongside said path, a follower movable with said carrier and engaging said cam, said cam and follower being operable to turn said carrier to a position in which the bristles of the brush face each station as the carrier moves through the latter, a first nozzle disposed at the first of said stations and pointed toward said path, a cleaning member disposed at an intermediate station and mounted to turn about an axis generally paralleling said path, power means for rotating said member, said member including a plurality of radially projecting fingers engageable with the bristles of the brush as said carrier passes through said intermediate station, a second nozzle disposed at a station subsequent to said intermediate station and pointed toward said path, and means for delivering a liquid under pressure through said nozzles and onto the bristles of the brush, said cam and follower being operable to arcuately oscillate said carrier and the brush at least as the carrier passes through said intermediate station.

9. Apparatus as defined in claim 8 in which said cleaning member includes a hub rotated by said power means and a plurality of sets of fingers anchored on said hub and projecting generally radially therefrom, said sets being equally spaced angularly around said hub and said fingers engaging the bristles of the brush to remove foreign material from the bristles.

10. Apparatus as defined in claim 9 including a plurality of knife blades anchored on said hub and extending longitudinally thereof with one blade being disposed between each adjacent set of fingers, said blades projecting radially from said hub and having their outer ends sharpened to cut material being removed from the bristles of the brush.

11. Apparatus as defined in claim 8 in which said cam and follower are operable as said carrier approaches the end of said path to oscillate the carrier vigorously thereby to shake excess liquid from the bristles of the brush.

12. Apparatus as defined in claim 8 in which said enclosure has a bottom wall collecting the liquid after the latter leaves the bristles of the brush, a filter disposed below said enclosure, and a tubular member communicating with the interior of said enclosure through said bottom wall and extending to said filter whereby used liquid drains through said tubular member to the filter.

13. Apparatus as defined in claim 8 including a cabinet, means supporting said enclosure in said cabinet, said cabinet having a drying chamber, a plurality of supports disposed within said chamber and operable to hold cleaned brushes, and means for circulating heated air through said chamber thereby to dry the brushes held by said supports.

14. Apparatus for cleaning a brush comprising, a horizontally elongated box having opposed first and second end walls with an opening formed in said first end wall, an elongated screen journaled in said box and extending between said end walls, said screw having a forward thread and a return thread, power operated means for turning said screw about its axis, a nut threaded on said screw to engage said forward thread when the nut is adjacent said first end wall and to engage said return thread when the nut is adjacent said second end wall whereby when said nut is substantially held against rotation the nut travels along said screw from said first end wall to said second end wall and back, an elongated sleeve encircling said screw and said nut and having a cam slot extending from one end of the sleeve to the other, a cam follower rigid with said nut and projecting through said cam slot with a free end outside said sleeve whereby the nut turns about the axis of said screw according to the shape of the slot as the nut moves along the screw, a clip mounted on said free end of said follower to releasably receive and hold a brush inserted through said opening when said nut is adjacent said first end wall, a plurality of stations disposed alongside said screw, said cam slot being shaped to turn said nut and hence the brush toward each station as the nut moves from said first end wall toward said second end wall and to oscillate the brush as the latter moves through each station, a first nozzle disposed at the first of said stations and pointed toward said screw, means for delivering a liquid under pressure through said nozzle to spray the bristles of the brush, a first power-rotated member disposed at the second of said stations, a plurality of sets of relatively stiff bristles projecting radially of said member to engage and clean the full length of the bristles of the brush, a second power-rotated member disposed at the third of said stations, a plurality of flexible fingers projecting raidally from said second member to wipe and clean the ends of the bristles of the brush, a second nozzle disposed at the fourth of said stations and pointed toward said screw, and means to deliver a liquid under pressure through said second nozzle and spray the bristles of the brush a second time.

15. Apparatus as defined in claim 14 including a plurality of notches formed in one side of said slot adjacent said first end wall, and resilient means operable to prevent said follower from entering said notches as said nut moves toward said second end wall and operable to urge the follower successively into the notches as the nut returns toward said first end wall, said follower being operable as it enters and leaves said notches to oscillate said nut vigorously thereby to shake excess liquid from the bristles of the brush.

16. Apparatus as defined in claim 14 including a third nozzle disposed adjacent said first nozzle and a fourth nozzle disposed adjacent said second nozzle, said first and second nozzles being shaped to spray the liquid in generally horizontal planes and said third and fourth nozzles being shaped to spray the liquid in generally vertical planes.

17. Apparatus as defined in claim 14 in which said sets of stiff bristles are equally spaced angularly around said first power-rotated member, a first set of knife blades mounted on said first power-rotated member and extending longitudinally thereof with one blade disposed between each adjacent set of bristles, said blades projecting radially from said member and having their outer ends sharpened to cut material being removed from the bristles on the brush, said flexible strips being arranged in sets equally spaced angularly around said second power-rotated member, and a second and similar set of knife blades similarly mounted on said second power-rotated member with one blade disposed between each adjacent set of strips.

18. Apparatus as defined in claim 14 including a cabinet, means supporting said box in said cabinet, said cabinet having a drying chamber and a separate storage chamber, a plurality of supports disposed within said drying chamber and operable to hold cleaned brushes, means for circulating heated air through said drying chamber thereby to dry the burshes held by said supports, and a plurality of racks disposed in said storage chamber to hold and store dried brushes.

* * * * *